US011672325B2

(12) United States Patent
Blumenthal et al.

(10) Patent No.: US 11,672,325 B2
(45) **Date of Patent: *Jun. 13, 2023**

(54) TOOL ATTACHMENT SYSTEM

(71) Applicant: Milwaukee Electric Tool Corporation, Brookfield, WI (US)

(72) Inventors: Aaron S. Blumenthal, Shorewood, WI (US); Jason D. Thurner, Menomonee Falls, WI (US); Christopher S. Hoppe, Cedarburg, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/700,119

(22) Filed: Mar. 21, 2022

(65) Prior Publication Data

US 2022/0211165 A1 Jul. 7, 2022

Related U.S. Application Data

(63) Continuation of application No. 16/800,336, filed on Feb. 25, 2020, now Pat. No. 11,304,503, which is a continuation of application No. PCT/US2020/017742, filed on Feb. 11, 2020.

(60) Provisional application No. 62/804,547, filed on Feb. 12, 2019.

(51) Int. Cl.
*A45F 5/02* (2006.01)

(52) U.S. Cl.
CPC ..... *A45F 5/021* (2013.01); *A45F 2005/026* (2013.01); *A45F 2200/0575* (2013.01)

(58) Field of Classification Search
CPC ..... A45F 5/021; A45F 2005/026; A45F 2200/0575; A45F 2200/0516; Y10T 24/1391; Y10S 24/60
See application file for complete search history.

(56) References Cited

U.S. PATENT DOCUMENTS

| | | | |
|---|---|---|---|
| 2,743,894 | A | 5/1956 | Ostnas |
| 2,990,987 | A | 7/1961 | Handler et al. |
| 4,419,794 | A | 12/1983 | Horton, Jr. |

(Continued)

FOREIGN PATENT DOCUMENTS

| | | |
|---|---|---|
| CN | 103703651 A | 4/2014 |
| DE | 7810070 | 7/1978 |

(Continued)

OTHER PUBLICATIONS

International Search Report and Written Opinion for International Application No. PCT/US2020/017742, dated Jun. 16, 2020, 13 pages.

(Continued)

*Primary Examiner* — Brian D Nash
(74) *Attorney, Agent, or Firm* — Reinhart Boerner Van Deuren s.c.

(57) ABSTRACT

A tool attachment system is provided. The tool attachment system includes a tool attachment device and a receiver that cooperate to lock or secure, for example, a bag or pouch. When the tool attachment device is coupled to the receiver, a locking mechanism locks the tool attachment device to the receiver in a locked position. To remove the tool attachment device, a user applies a force to a button to cause the tool attachment device to disengage from the receiver.

19 Claims, 8 Drawing Sheets

(56) References Cited

U.S. PATENT DOCUMENTS

| | | | | |
|---|---|---|---|---|
| 4,718,586 | A | 1/1988 | Hagino | |
| 4,721,276 | A | 1/1988 | Moss | |
| 5,014,892 | A | 5/1991 | Copeland | |
| 5,054,170 | A | 10/1991 | Otrusina | |
| 5,163,591 | A | 11/1992 | Leiserson et al. | |
| 5,201,858 | A | 4/1993 | Otrusina | |
| 5,319,349 | A | 6/1994 | Smith, III | |
| 5,597,102 | A | 1/1997 | Saarikko | |
| 5,598,958 | A | 2/1997 | Ryan, III et al. | |
| 5,622,296 | A | 4/1997 | Pirhonen | |
| 5,664,292 | A | 9/1997 | Chen | |
| 5,779,115 | A | 7/1998 | Parkas et al. | |
| 5,850,996 | A | 12/1998 | Liang | |
| 5,983,686 | A | 11/1999 | Lee | |
| 6,041,444 | A | 3/2000 | McKinney | |
| 6,098,858 | A | 8/2000 | Laugesen | |
| 6,161,741 | A | 12/2000 | French | |
| 6,193,546 | B1 | 2/2001 | Sadler | |
| 6,279,362 | B1 | 8/2001 | Lee | |
| 6,290,534 | B1 | 9/2001 | Sadler | |
| 6,439,017 | B1 | 8/2002 | Lee | |
| 6,626,336 | B1 | 9/2003 | Krusell | |
| 6,669,155 | B2 | 12/2003 | Ron | |
| 6,685,067 | B2 | 2/2004 | French | |
| 6,719,178 | B1 | 4/2004 | Taylor | |
| 6,786,372 | B2 | 9/2004 | Enkerlin | |
| 6,880,794 | B1 | 4/2005 | Kahn | |
| 6,955,279 | B1 | 10/2005 | Mudd | |
| 7,686,196 | B2 | 3/2010 | Panosian et al. | |
| 7,690,541 | B2 | 4/2010 | Pellegrini | |
| 7,699,197 | B2 | 4/2010 | Panosian et al. | |
| 8,020,821 | B2 | 9/2011 | Chen | |
| 8,166,694 | B2 | 5/2012 | Swan | |
| 8,499,986 | B2 | 8/2013 | Knight | |
| 8,613,564 | B2 | 12/2013 | Busch | |
| 8,919,622 | B1 * | 12/2014 | Gabriel | A45F 5/021 224/159 |
| 8,919,623 | B1 | 12/2014 | Bergeron | |
| 9,101,198 | B2 | 8/2015 | Tseng | |
| D741,161 | S | 10/2015 | Buresh, II et al. | |
| 9,657,893 | B2 | 5/2017 | Buresh, II et al. | |
| 9,664,480 | B2 | 5/2017 | Faifer | |
| 9,780,583 | B2 | 10/2017 | Furui et al. | |
| 10,271,634 | B1 | 4/2019 | Eynav | |
| 11,047,644 | B2 | 6/2021 | Shearer | |
| 2003/0047575 | A1 * | 3/2003 | Enkerlin | A45F 5/02 224/196 |
| 2005/0258204 | A1 | 11/2005 | Evans et al. | |
| 2006/0104735 | A1 | 5/2006 | Zeiler et al. | |
| 2006/0246963 | A1 * | 11/2006 | Tages | H04M 1/04 455/575.1 |
| 2007/0099469 | A1 | 5/2007 | Sorensen | |
| 2008/0083803 | A1 | 4/2008 | Brantner et al. | |
| 2009/0095785 | A1 | 4/2009 | Woolery | |
| 2010/0071168 | A1 | 3/2010 | Miller | |
| 2011/0019081 | A1 | 1/2011 | Eynav | |
| 2011/0142436 | A1 | 6/2011 | Eynav | |
| 2013/0008933 | A1 | 1/2013 | Clifford | |
| 2014/0291362 | A1 | 10/2014 | Victor | |
| 2017/0122701 | A1 | 5/2017 | Lim et al. | |
| 2017/0235211 | A1 | 8/2017 | Eynav | |
| 2018/0331708 | A1 | 11/2018 | Craig | |
| 2019/0014893 | A1 | 1/2019 | Record et al. | |
| 2020/0253365 | A1 * | 8/2020 | Blumenthal | B25H 3/00 |

FOREIGN PATENT DOCUMENTS

| | | |
|---|---|---|
| DE | 3027550 | 3/1982 |
| DE | 8810011 | 9/1988 |
| DE | 102010046583 | 5/2011 |

OTHER PUBLICATIONS

Spider Holster SpiderPro Dual Camera System (DCS), Amazon.com, htips//wv1w.arnazon.com/exec:/obidos/ASIN/B004TGP0DS/ezvid02-20, believed to be commercially available as early as May 2011, 12 pages.

* cited by examiner

TOOL ATTACHMENT SYSTEM

CROSS-REFERENCE TO RELATED PATENT APPLICATION

The present application is a continuation of U.S. patent application Ser. No. 16/800,336, filed Feb. 25, 2020, which is a continuation of International Application No. PCT/US2020/017742, filed on Feb. 11, 2020, which claims the benefit of and priority to U.S. Provisional Application 62/804,547, filed on Feb. 12, 2019, which are incorporated herein by reference in their entireties.

BACKGROUND OF THE INVENTION

The present invention relates generally to the field of tools. The present invention relates specifically to a system for removably attaching items to a belt, such as a tool belt, and/or to a job site location.

SUMMARY OF THE INVENTION

One embodiment of the invention relates to a tool attachment system. The tool attachment system has a receiver configured to attach to a tool belt and a tool attachment device. The tool attachment device has a locking mechanism and removably couples to the receiver. The locking mechanism locks the tool attachment device to the receiver when the locking mechanism is in a locked position. An actuator is also coupled to the tool attachment device. When a force is applied to the actuator, the actuator causes the locking mechanism to move to an unlocked position, and the force causes the tool attachment device to disengage from the receiver.

Another embodiment of the invention relates to a tool attachment system. The tool attachment system has a tool attachment device and a receiver. The tool attachment device has comprising a disk and a locking pin. The receiver has a channel, a hole, and an actuator. The channel engages the disk of the tool attachment device to secure the tool attachment device to the receiver. The hole receives the locking pin and prevents lateral movement of the tool attachment device relative to the receiver. The actuator has a button and a post coupled to the button. The post has an angled surface and a slot that receives the locking pin, such that in a locked position the locking pin passes through the slot to the hole. When the tool attachment device is coupled to the receiver, the locking pin is received in the hole of the receiver and the tool attachment device is locked in the receiver. When a force is applied to the button of the actuator, the angled surface of the post on the actuator generates a force on the locking pin that is transverse to the force on the button and causes the locking pin to move out of the hole of the receiver to an unlocked position.

Another embodiment of the invention relates to a tool attachment system with a tool attachment device and a receiver. The tool attachment device has a body, a disk, and a locking pin. The body forms an upper wall and is attached to a pouch. The disk extends outwardly from the upper wall. The locking pin extends through the disk. The receiver has a channel, an overhanging flange, and a hole. The channel engages with the disk of the tool attachment device. The overhanging flange captures the disk within the channel. The hole receives the locking pin in a locked position. The actuator has a button and a post. The post has an angled surface and an angled slot that receives the locking pin, such that the locking pin passes through the slot to the hole in the locked position. When the tool attachment device is coupled to the receiver, the locking pin is received in the hole of the receiver and the tool attachment device is locked in the receiver. When a force is applied to the button of the actuator, the angled slot of the post on the actuator generates a force on the locking pin that is transverse to the force on the button and causes the locking pin to move out of the hole of the receiver to an unlocked position.

Another embodiment of the invention relates to a tool attachment system. The tool attachment system includes a tool attachment device configured to support a pouch or tool holder. The tool attachment system includes a receiver configured to attach to a tool belt. The tool attachment device is removably coupled to the receiver and includes a locking mechanism that locks the tool attachment device to the receiver when the locking mechanism is in the locked position. The tool attachment device includes an actuator, and when force is applied to the actuator, the actuator causes the locking mechanism to move to an unlocked position, and the force causes the tool attachment device to disengage from the receiver.

In various embodiments, the tool attachment device includes a disk-shaped coupling element that is received within a channel defined within the receiver. In various embodiments, the tool attachment device is pivotally coupled to the receiver such that the tool attachment device rotates relative to the receiver about an axis perpendicular to a front face of the channel. In various embodiments, the tool attachment system has a low profile having a width measured from the tool belt of less than 1 inch.

Additional features and advantages will be set forth in the detailed description which follows, and, in part, will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a tool attachment system are shown. In general, the tool attachment system discussed herein includes a tool attachment device/component that is coupled to a pouch, loop, or other tool/item supporting component and a receiver that is coupled to a tool belt (or other structure/device from which a tool pouch may be supported as discussed below). In general, the receiver includes a coupling structure, such as a channel, that removably couples to a corresponding mating structure on attachment device. A locking mechanism is operable via an actuator supported by the tool attachment device to unlock the tool attachment device from the receiver allowing the pouch and the tool attachment device to be released from the receiver.

In the specific embodiments discussed herein, the actuator is configured and positioned relative to the tool attachment device in a manner such that force applied by the user to the actuator to release the locking mechanism also causes the tool attachment device to decouple from the receiver. Applicant believes that this arrangement provides a design that will allow the users to conveniently remove tools and other items from the tool belt with a single fluid motion. In the particular design discussed herein, this movement is an upward movement.

Further, Applicant has found that the design of the tool attachment device and receiver provides for a tool belt attachment system with a relatively low width. This allows the tool/items supported by the pouch to be worn on a tool belt close to the user's body and reduces torque applied to the tool belt and receiver. In addition, in specific embodiments, the tool belt attachment device is rotatably coupled to the receiver allowing the tool belt attachment device to rotate about an axis generally perpendicular to the receiver. Applicant believes that this swiveling action allows for the tool attachment device and associated pouch to swivel such that the pouch remains upright as the user's body position changes.

Figure 1:
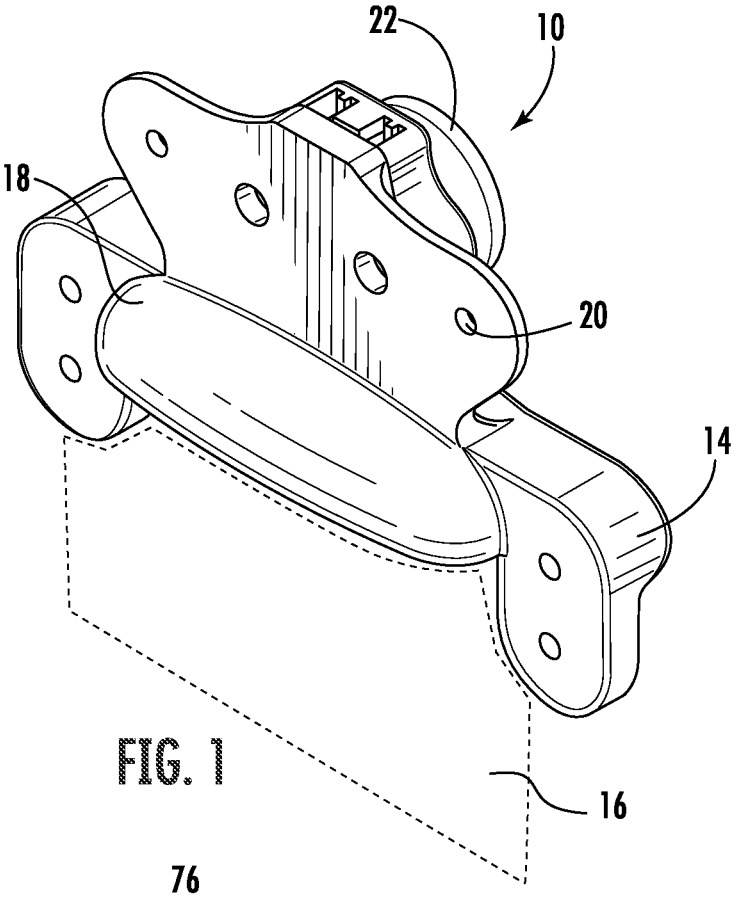
FIG. 1 is a front perspective view of a pouch or tool attachment device, according to an exemplary embodiment.
Figure 2:
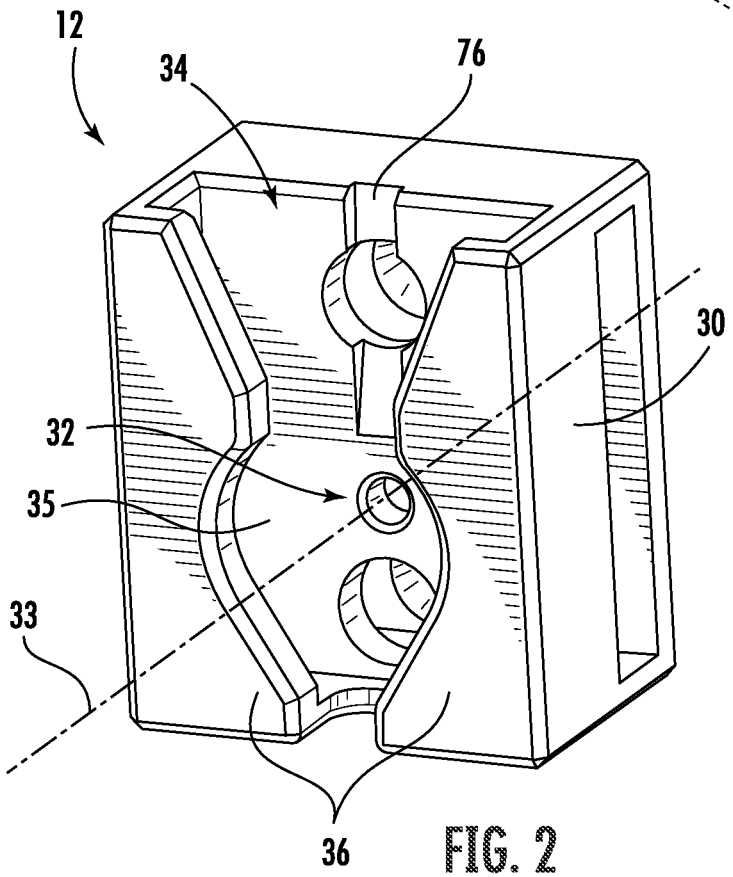
FIG. 2 is a perspective view of a receiver to which the tool attachment device of FIG. 1 is removably coupled, according to an exemplary embodiment.
Figure 3A:
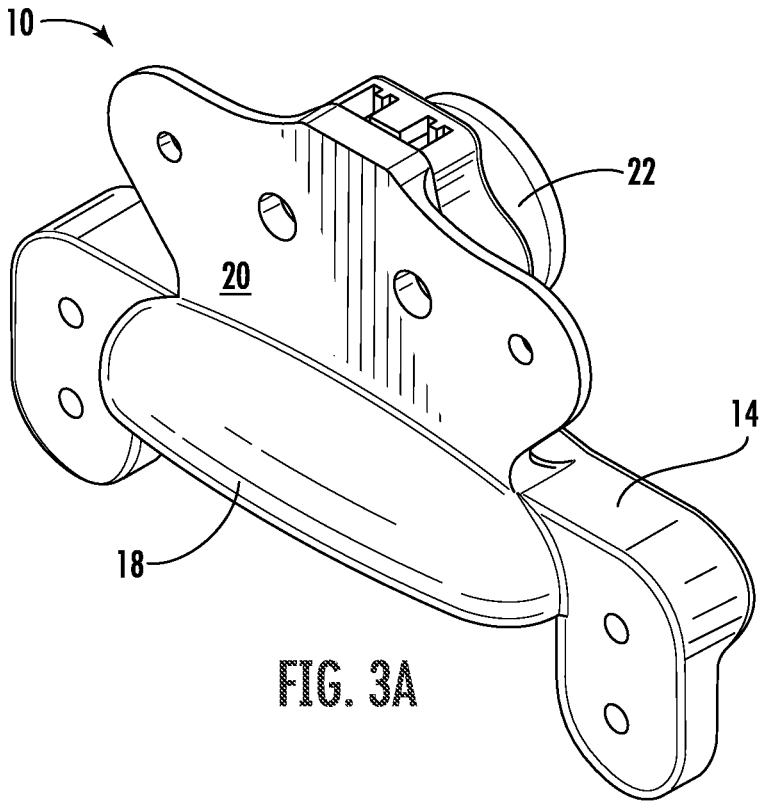
FIGS. 3A-3D show various perspective views of the tool attachment device of FIG. 1, according to an exemplary embodiment.
Figure 3B:
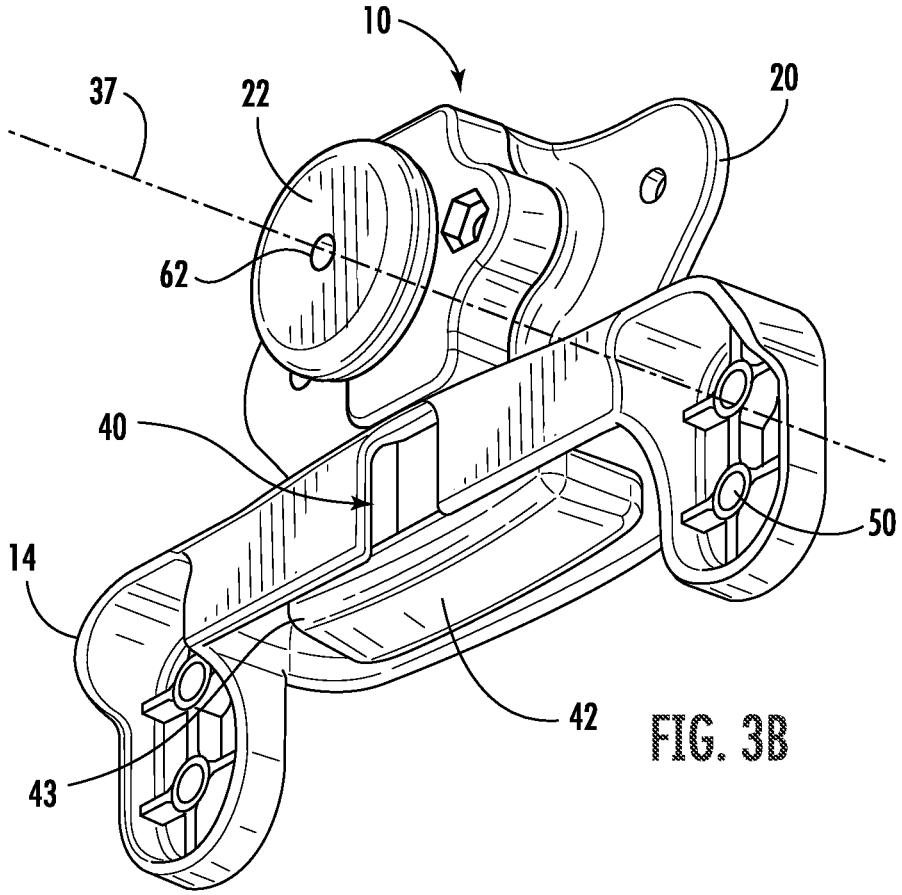
Figure 3C:
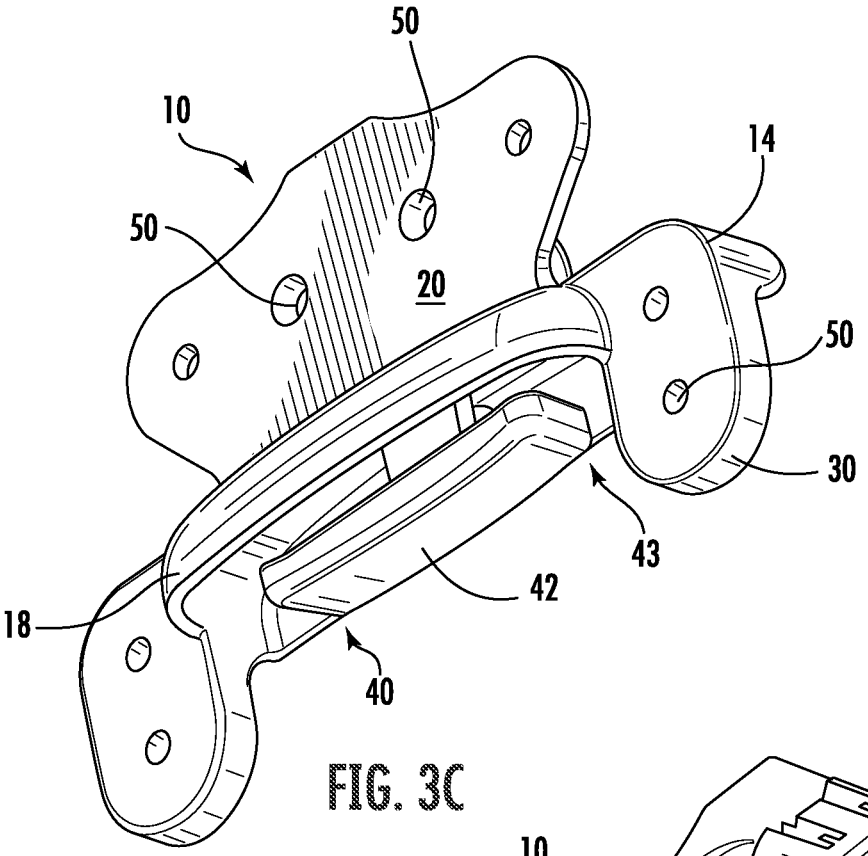
Figure 3D:
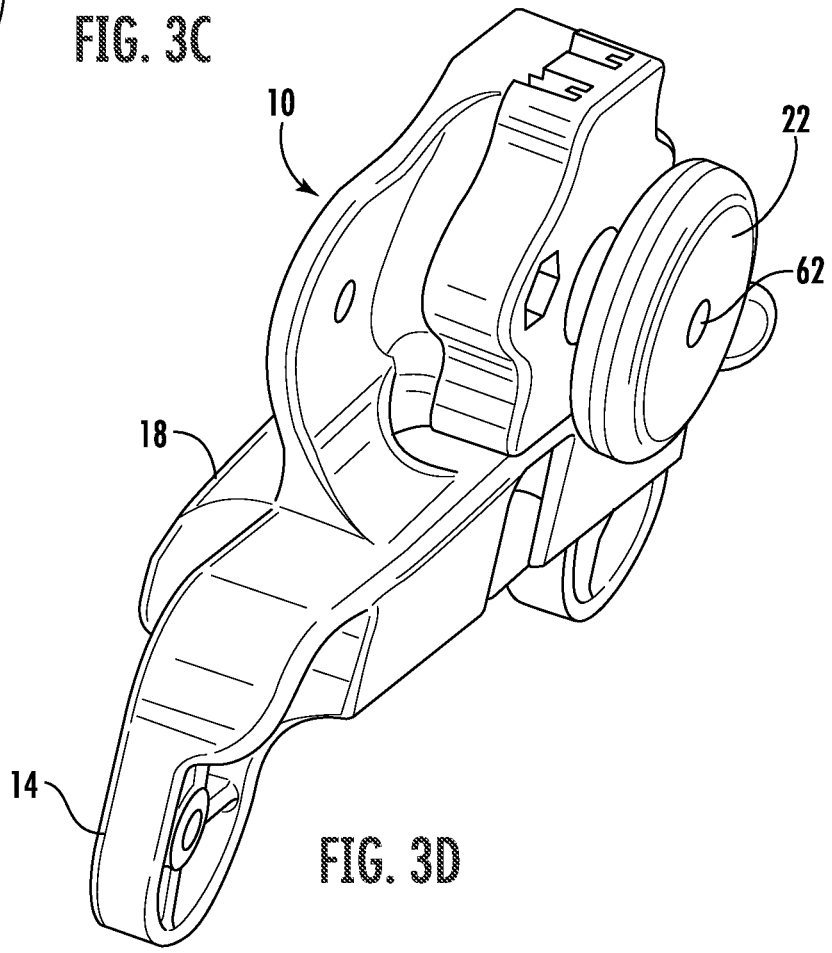

Referring to FIG. 1 and FIG. 2, a tool attachment system, including a tool attachment device 10 and a receiver 12, is shown according to an exemplary embodiment. Tool attachment device 10 includes a body 14 that is attached to a holder, loop, pouch, etc., shown as schematically as pouch 16 in FIG. 1. In general, receiver 12 is coupled to a tool belt and tool attachment device 10, and the tool/item supported by pouch 16 is removably coupled to the tool belt via engagement between corresponding coupling structures of receiver 12 and tool attachment device 10. Thus, this allows the user to easily add and remove tools/items to and from a tool belt or other structure to which receiver 12 is attached. In various embodiments, pouch 16 comprises ballistic nylon, leather, or plastic.

Body 14 includes a shroud 18, and as will be discussed in more detail below, shroud 18 partially surrounds an actuator button to limit inadvertent disengagement from receiver 12. Body 14 also includes an upper wall 20 that extends upward and away from shroud 18. Tool attachment device 10 includes a mating structure, shown as disk 22, that extends outward from upper wall 20. A bag securing mechanism or coupling structure 24 is configured to securely couple pouch 16 to body 14, e.g., under shroud 18 of tool attachment device 10. Upper wall 20 and/or coupling structure 24 are outward faces of tool attachment device 10. For example, upper wall 20 and/or coupling structure 24 face outwardly when pouch 16 is attached to a user's belt.

In some embodiments, pouch 16 is coupled to body 14. For example, fasteners couple pouch 16 to coupling structure 24 of tool attachment device 10. As another example, coupling structure 24 includes a plurality of attachment points or holes 50 to secure pouch 16 to body 14 and rivets through holes 50 of coupling structure 24 attach pouch 16 to tool attachment device 10 and/or hold portions of housings that make up tool attachment device 10. Coupling structure 24 captures and/or fastens pouch 16 to tool attachment device 10 to securely and interchangeably couple contents of pouch 16 (e.g., tools) to different receivers 12. For example, tool attachment device 10 is coupled to a first receiver 12 on a user's belt and a second receiver 12 at the job site.

Receiver 12 includes a coupling structure or body 30, shown as channel 32, that is sized to reversibly, non-permanently engage with disk 22. Receiver 12 receives disk 22 and secures disk 22 of tool attachment device 10 within receiver 12. While in the locked position, disk 22 pivots or rotates about a rotational axis 33 of receiver 12. In general, disk 22 is slidably received within channel 32 through a channel entrance opening 34 such that tool attachment device 10 is coupled to receiver 12. A front face 35 of channel 32 is formed on an interior of receiver 12. Body 30 includes an overhanging flange 36 that captures disk 22 within channel 32 and prevents tool attachment device 10 from disengaging from receiver 12 via lateral movement (e.g., movement in a direction other than along the length of channel 32).

Referring to FIGS. 3A-3D, detailed perspective views of tool attachment device 10 are shown. As shown best in FIGS. 3B and 3C, tool attachment device 10 includes an actuator 40 that includes a button portion 42. In some embodiments, actuator 40 is coupled to tool attachment device 10 to release disk 22 from receiver 12. As shown, the inner surface of shroud 18 defines a hollow chamber 43 within which button portion 42 is received. In this manner, shroud 18 partially surrounds actuator 40 and/or button 42 and protects button 42 from inadvertent contact/actuation and inadvertent disengagement of tool attachment device 10 from receiver 12.

In a locked position (FIG. 6), tool attachment device 10 is removably coupled to receiver 12 via disk 22 that locks or secures translation of tool attachment device 10 relative to receiver 12. In some embodiments, disk 22 rotates within receiver 12 to removably and pivotally couple tool attachment device 10 to receiver 12. For example, pouch 16 can rotate and/or swivel about receiver 12 attached to the belt of a user to remain upright when the user bends over. When the user applies a force to actuator 40, disk 22 moves to an unlocked position (FIGS. 1 and 2). The force on actuator 40 causes tool attachment device 10 to disengage from receiver 12. Thus, a user can press button 42 to release both the locking mechanism 45 (e.g., move locking pin 60) and remove tool attachment device 10 from receiver 12.

Figure 4:
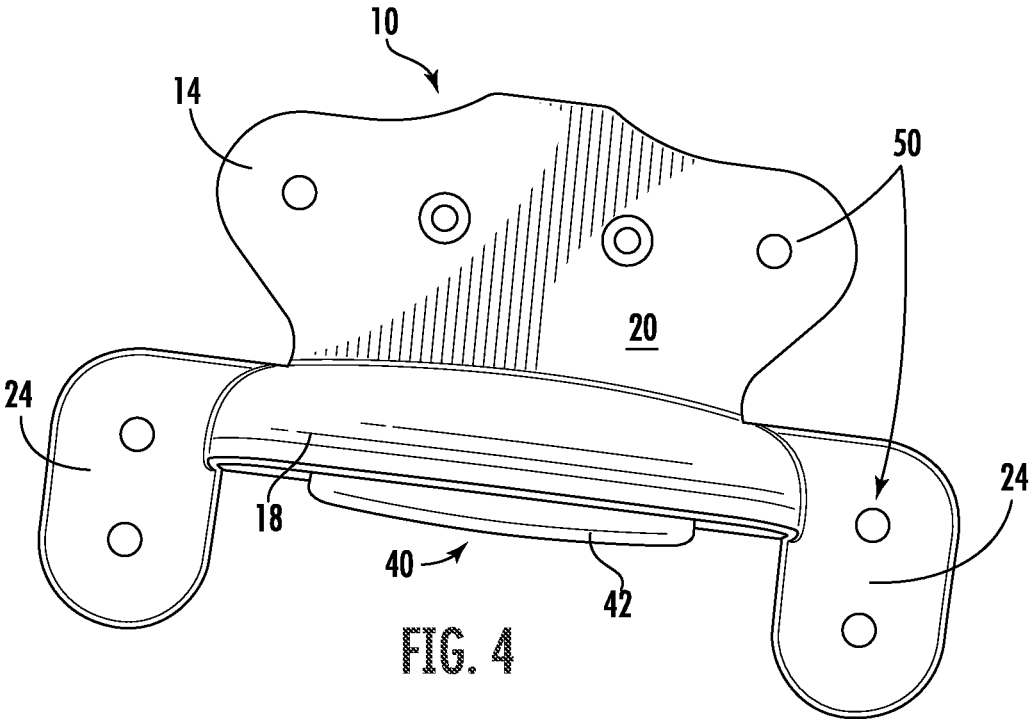
FIG. 4 is a front view of the tool attachment device of FIG. 1, according to an exemplary embodiment.

Referring to FIG. 4, body 14 of tool attachment device 10 includes a plurality of attachment points, shown as holes 50, that can be used to couple pouch 16 or other containers to tool attachment device 10. Further, shroud 18 protrudes a short distance away from the front face of tool attachment device 10, which allows for the user to access button portion 42 when pouch 16 is attached to body 14 via holes 50.

Figure 5:
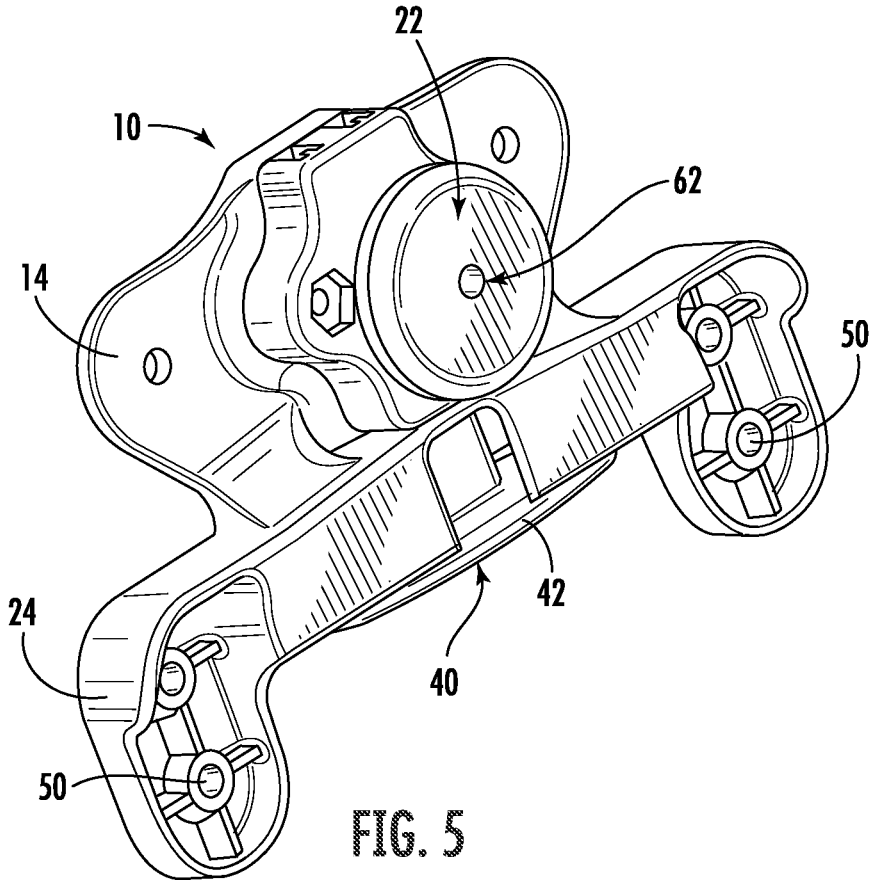
FIG. 5 is a detailed rear view of the tool attachment device of FIG. 1, according to an exemplary embodiment.
Figure 6:
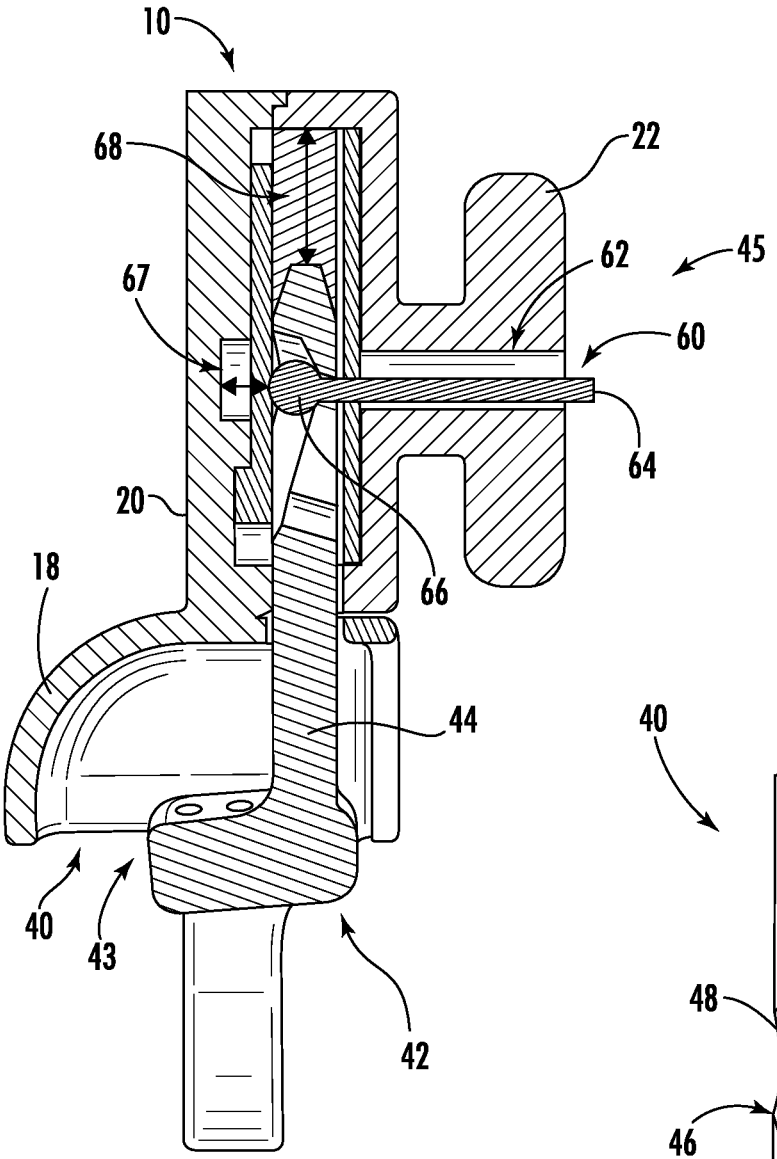
FIG. 6 is a cross-sectional view of the tool attachment device of FIG. 1, according to an exemplary embodiment.
Figure 9:
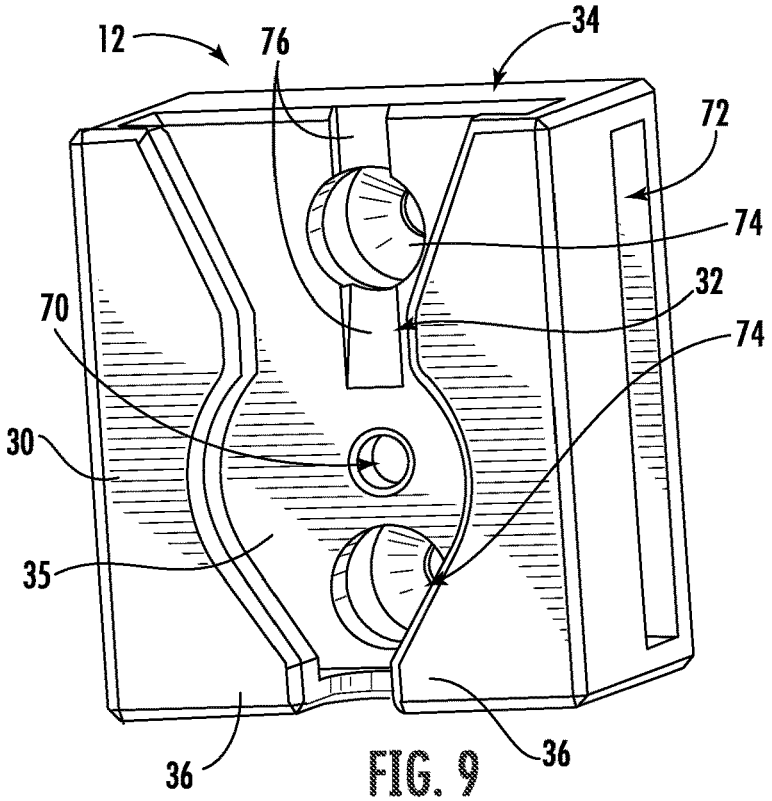
FIG. 9 is a detailed front view of the receiver of FIG. 2, according to an exemplary embodiment.
Figure 10:
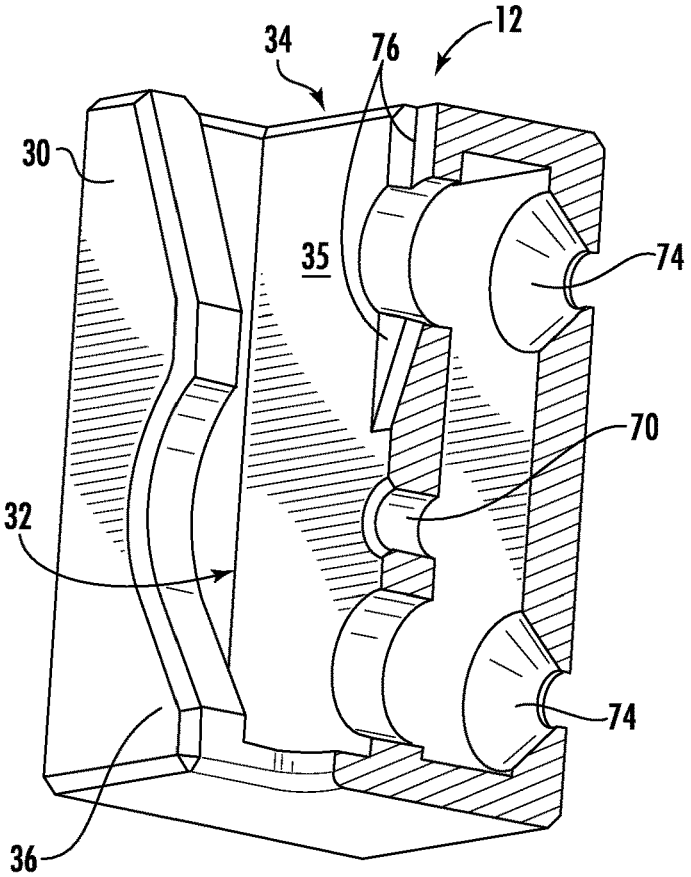
FIG. 10 is a detailed perspective cross-sectional view of the receiver of FIG. 2, according to an exemplary embodiment.

Referring to FIG. 5 and FIG. 6, tool attachment device 10 includes a locking mechanism 45 that retains tool attachment device 10 to receiver 12 until button 42 of actuator 40 is pressed. In the specific embodiment shown, locking mechanism 45 of tool attachment device 10 includes a locking pin 60 that extends through a pinhole 62 through disk 22. In some embodiments, both disk 22 and locking pin 60 are configured to be received in channel 32 defined within receiver 12. In the locked position shown in FIG. 6, the outer end 64 of locking pin 60 extends out of pinhole 62 past the rear face of disk 22 and then is received within a pinhole 70 in receiver 12 (see FIG. 9). The engagement between pin 60 and pinhole 70 in receiver 12 locks tool attachment mechanism 10 to receiver 12 to prevent lateral movement of tool attachment device 10 relative to receiver 12.

Figure 7:
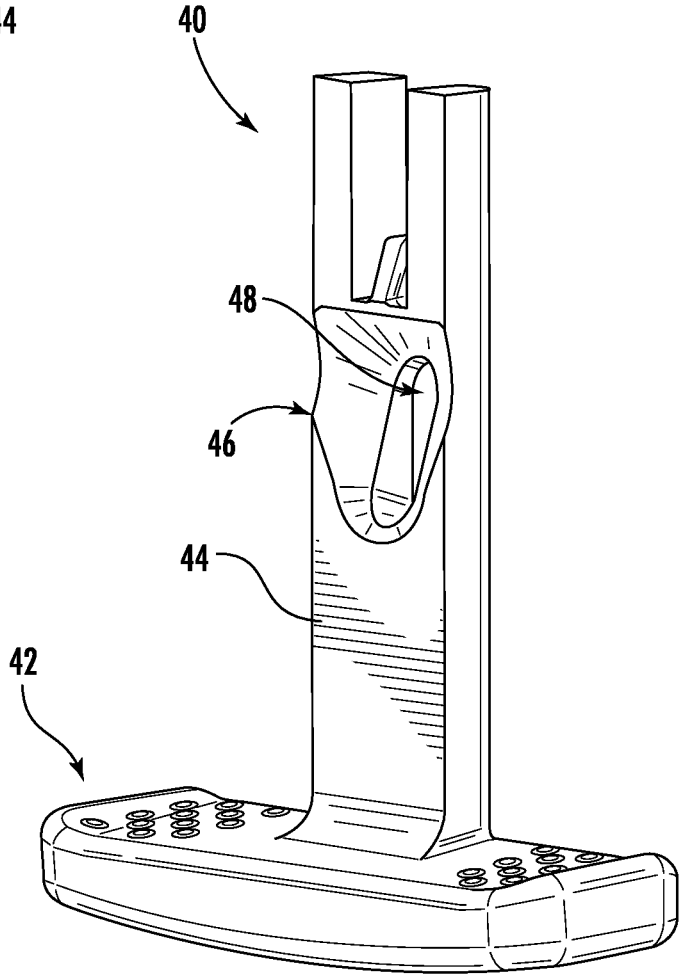
FIG. 7 is a detailed front perspective view of an actuator of the tool attachment device of FIG. 1, according to an exemplary embodiment.
Figure 8A:
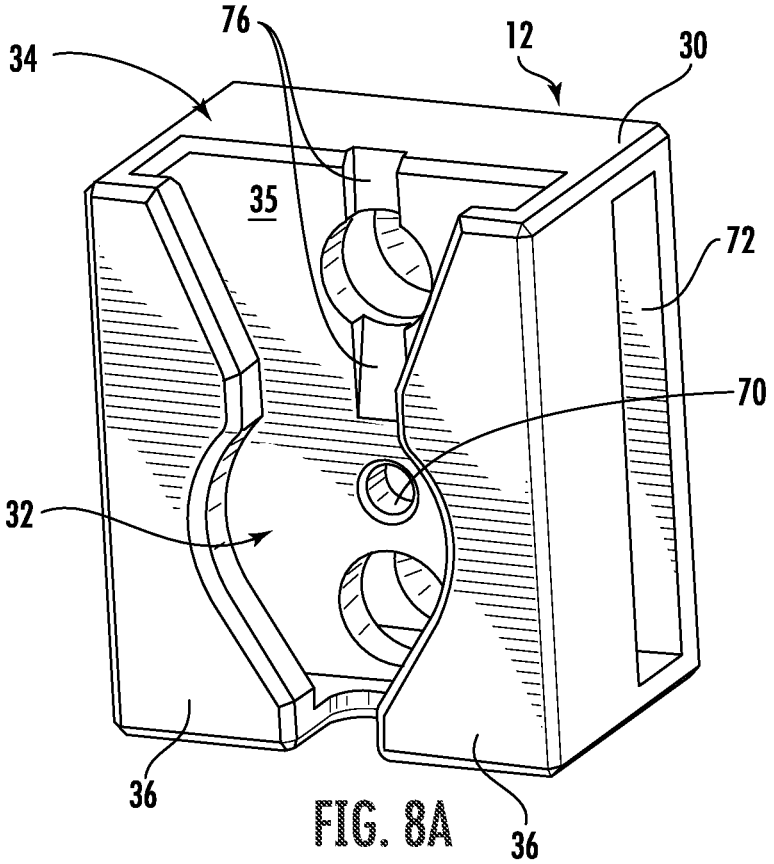
FIGS. 8A-8D show various perspective views of the receiver of FIG. 2, according to an exemplary embodiment.
Figure 8B:
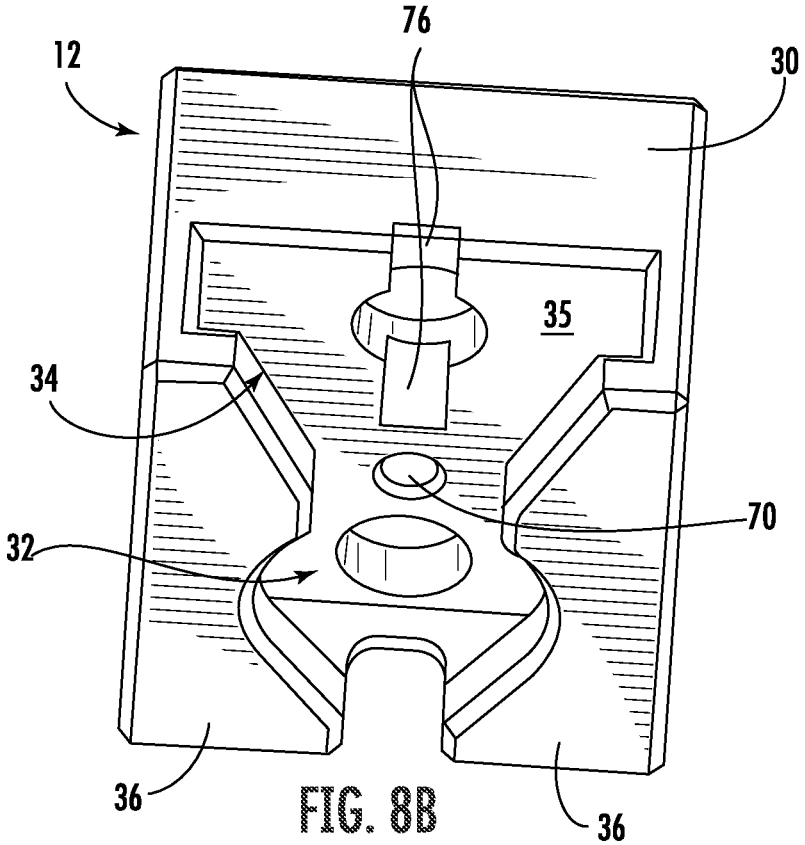
Figure 8C:
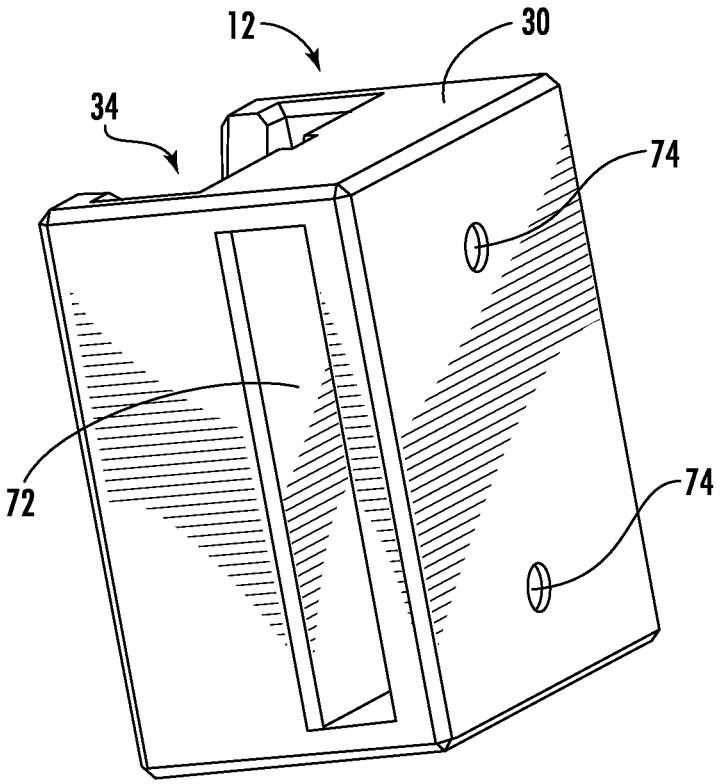
Figure 8D:
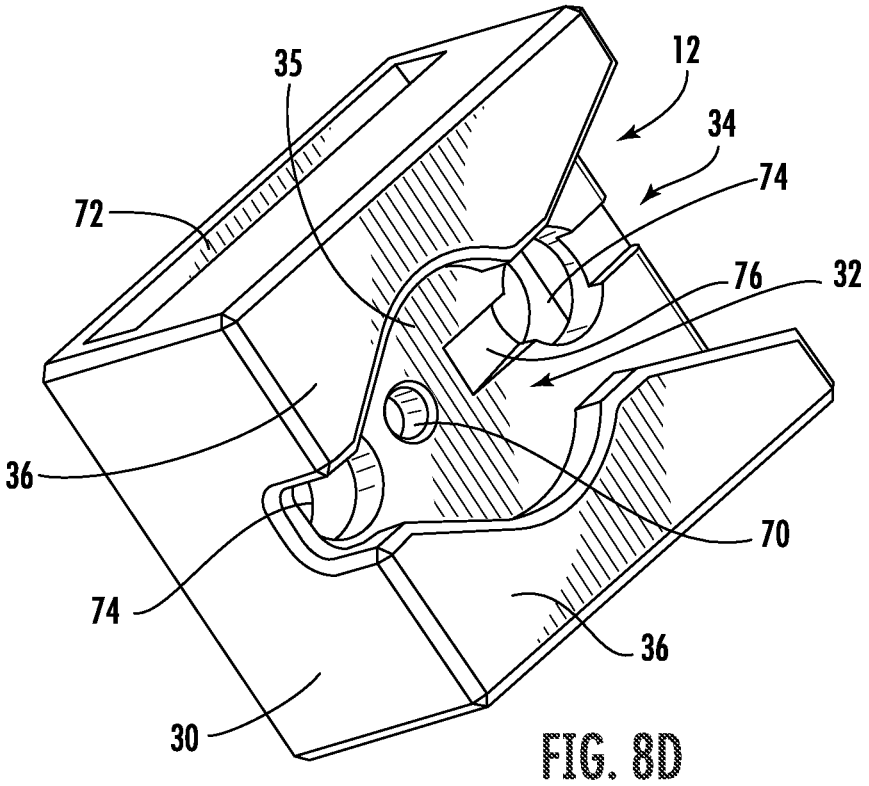

As shown in FIG. 6 and FIG. 7, actuator 40 includes a post 44 that extends upward from button 42. Post 44 includes an angled surface 46 and a pin slot 48. For example, angled surface 46 surrounds pin slot 48 to form an angled pin slot 48. Pin slot 48 receives the inner end of pin 60, and angled surface 46 engages with a portion of pin 60 to move pin 60 between locked and unlocked positions To move tool attachment device 10 from the locked position of FIG. 6 to the unlocked position in which tool attachment device 10 can be disengaged from receiver 12, an upward (in the orientation of FIG. 6) force is applied to button 42. This upward force causes upward movement of actuator post 44, and the interaction between angled surface 46 and inner pin end 66 draws pin 60 to the left in the orientation of FIG. 6 and into pinhole 62. When pin 60 is within pinhole 62, it is no longer within pinhole 70 of receiver 12 and thus, pin 60 is no longer in position to prevent tool attachment device 10 from being disengaged from receiver 12 via operation of button 42. This configuration allows the user to continue to provide an upward force to tool attachment device 10, causing disk 22 to slide out from receiver 12 and disengage tool attachment device 10 from receiver 12.

In this configuration, when tool attachment device 10 is coupled to receiver 12, locking pin 60 passes through pinhole 62 of disk 22 and slot 48 of post 44 and is received in pinhole 70 of receiver 12. This configuration locks the translational movement of tool attachment device 10 in receiver 12. When a user applies a force to button 42, angled surface 46 of slot 48 on post 44 generates a force on locking pin 60 that is transverse to the force on button 42 and causes locking pin 60 to move out of pinhole 60 of receiver 12 and to an unlocked position. Thus, as can be seen, this arrangement allows for both unlocking and removal of tool attachment device 10 from receiver 12 with the same single application of force.

Referring still to FIG. 6, tool attachment device 10 includes at least two biasing elements to maintain tool attachment device 10 in the locked position until a user actuates button 42. For example, tool attachment device 10 includes both a pin spring 67 and a button spring 68. In general, pin spring 67 biases locking pin 60 into a locked position and button spring 68 biases actuator 40 (e.g., button 42). Pin spring 67 is oriented in the horizontal direction between body 14 and pin 60 to bias pin 60 in the locked position of FIG. 6. Button spring 68 is oriented in the vertical direction between body 14 and actuator post 44 to bias actuator 40 downward to the locked position of FIG. 6. In some embodiments, pin spring 67 and/or button spring 68 are compression springs. In various embodiments, angled surface 48, pin spring 67, and/or button spring 68 cooperate to bias button 42 downward to bias locking mechanism 45 into the locked position of FIG. 6.

Further, the design discussed herein allows for a removable tool belt pouch 16 while at the same time keeping pouch 16 relatively close to the belt and user's body, improving the stability and comfort of the tool belt. In various embodiments, the horizontal distance from the tool belt to button 42 is less than 1 inch, more specifically, less than 0.75 inches.

Referring to FIG. 8A-8D, FIG. 9, and FIG. 10, details of receiver 12 are shown. As noted above, receiver 12 includes a pin receiving hole 70 for receiving pin 60 to providing locking, as discussed above. In some embodiments, receiver 12 includes a pin ramp 76. Pin ramp 76 is an angled surface that pushes locking pin 60 into disk 22 as disk 22 is inserted into channel 32. For example, pin ramp 76 is located in a radial center of disk 22 to depress locking pin 22 at the radial center into disk 22 until pin 60 is aligned with pinhole 70. As disk 22 and locking pin 60 are depressed within channel 32, pin 60 moves within disk 22 as pin ramp 76 slopes towards and approaches face 35. Between pin ramp 76 and pinhole 70, locking pin 60 may be fully inserted within disk 22. Once aligned, locking pin 60 slides into pinhole 70 to lock tool attachment device 10 relative to receiver 12 about a rotational axis 37 of locking pin 60. Pin ramp 76 reduces interference of pin 60 with other structures on receiver 12, for example, fastener holes 74. Using a pin ramp 76, locking pin 60 travels through channel 32 over fastener holes 74 without catching on an edge or other interference with hole 74.

Receiver 12 includes a belt slot 72 through which a user belt is threaded to attach receiver 12 to the belt. Belt slot 72 is configured to thread a belt or rope through slot 72 and attach receiver 12. The belt can then be attached to the user or a suitable structure, such as a wall, railing, toolbox, or rack. Additional attachment methods such as fasteners, adhesives, hook-loop fasteners, and/or welding may be used to couple receiver 12 to a supporting structure and releasably secure pouch 16 at the desired location. In some embodiments, receiver 12 is constructed within a tool, such as a lift, so that the user can detach pouch 16 from a belt and secure pouch 16 to the tool.

Receiver 12 also includes fastener holes 74. Fastener holes 74 allow the user to fasten receiver 12 to a structure as desired via a fastener, such as a screw. Holes 74 allow tool attachment system 10 discussed herein to provide from tool/item support locations at a wide variety of locations throughout a job site. Thus, in this manner, tool attachment device 10 and receiver 12 allow a user to attach several pouches 16 for a job onto a tool belt, walk to the job site, then unload some or all of the pouches 16 from the belt. Additional receivers 12 may be located at the location where work is to be performed, such as on the side of a ladder, on a bucket truck, on a wall, on a railing, on a cart, etc. This allows the user to conveniently transfer pouches 16 supported from the tool belt to the onsite receivers 12 without needing to remove the tool or items from the pouch 16.

As noted above, tool attachment device 10 and receiver 12 are configured to allow tool attachment device 10 and the attached pouch 16 to swivel or pivot within receiver 12 such that the pouch remains upright as the user moves/changes position preventing the contents of the pouching from being spilled. In general, the circular cross-sectional shape of disk 22 and the shape of channel 32 of receiver 12 and the circular shape of pin 60 and pinhole 70 in receiver 12 allows for the pivoting movement tool attachment device 10 relative to receiver 12. As the user moves, tool attachment device 10 rotates about an axis 33 perpendicular to face 35 of receiver 12, providing the swiveling movement that allows tool attachment device 10 and the associated pouch to remain upright. For example, when tool attachment device 10 is pivotally coupled to receiver 12, tool attachment device 10 and/or pouch 16 rotate relative to receiver 12 about axis 33 that is perpendicular to front face 35 of channel 32 of receiver 12.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more components or elements, and is not intended to be construed as meaning only one.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures, are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A tool attachment system, comprising:

a receiver configured to attach to a tool belt;

a tool attachment device releasably coupled to the receiver, the tool attachment device comprising a locking mechanism that locks the tool attachment device against translational movement relative to the receiver when the locking mechanism is in a locked position; and an actuator coupled to the tool attachment device;

wherein the actuator is configured to move the locking mechanism to an unlocked position when a force is applied to the actuator in a designated direction, wherein the designated direction is an upward direction, and wherein in the unlocked position the locking mechanism allows translational movement of the tool attachment device relative to the receiver such that the tool attachment device is configured to move in the designated direction to release from the receiver.

2. The tool attachment system of claim 1, wherein the tool attachment device further comprises a disk, and wherein the receiver defines a channel that receives the disk.

3. The tool attachment system of claim 2, wherein the tool attachment device is pivotally coupled to the receiver and configured to rotate relative to the receiver about an axis that is perpendicular to a front face of the channel of the receiver.

4. The tool attachment system of claim 3, wherein the actuator further comprises a button, wherein the force is applied to the button of the actuator.

5. The tool attachment system of claim 4, wherein the tool attachment device further comprises a shroud, and wherein the shroud partially surrounds the button to limit inadvertent release of the tool attachment device from the receiver.

6. The tool attachment system of claim 5, wherein the tool attachment device further comprises a bag securing mechanism that is configured to attach a pouch under the shroud of the tool attachment device.

7. The tool attachment system of claim 6, wherein the pouch is coupled to the tool attachment device through a plurality of attachment points.

8. The tool attachment system of claim 4, wherein when the receiver is coupled to the tool belt, the tool attachment system has a width measured from the tool belt to the button of the actuator that is less than 1 inch.

9. A tool attachment system, comprising:

a receiver configured to attach to a tool belt;

a tool attachment device releasably coupled to the receiver, the tool attachment device comprising a locking mechanism that locks the tool attachment device against translational movement relative to the receiver when the locking mechanism is in a locked position; and an actuator coupled to the tool attachment device, the actuator configured to move the locking mechanism to an unlocked position that allows translational movement of the tool attachment device relative to the receiver when a force is applied to the actuator; and wherein the tool attachment device is freely rotatable about an axis generally perpendicular to the receiver when the locking mechanism is in a locked position.

10. The tool attachment system of claim 9, wherein the tool attachment device further comprises a mating structure, and wherein the receiver defines a channel that receives the mating structure.

11. The tool attachment device of claim 10, wherein the mating structure is a disk.

12. The tool attachment system of claim 9, further comprising a bag securing mechanism that attaches a pouch to the tool attachment device.

13. The tool attachment system of claim 9, wherein the actuator further comprises a button, wherein the force is applied to the button to move the locking mechanism into the unlocked position.

14. A tool attachment system, comprising:

a tool attachment device, comprising a mating structure and a locking pin;

a receiver releasably coupled to the tool attachment device, the receiver comprising a channel that receives the mating structure of the tool attachment device, and a pinhole that receives the locking pin of the tool attachment device; and an actuator, comprising a button, and a post coupled to the button and positioned at least in part between the receiver and the tool attachment device, the post defining a slot;

wherein, when tool attachment device is coupled to the receiver in a locked position, the locking pin passes through the slot and engages the pinhole such that the engagement between the locking pin and the pinhole prevents translational movement of the tool attachment device relative to the receiver; and wherein, when a force is applied to the button of the actuator, the post generates a force on the locking pin that moves the locking pin out of the pinhole of the receiver and allows translational movement of the tool attachment device relative to the receiver.

15. The tool attachment system of claim 14, wherein the mating structure is a disk.

16. The tool attachment system of claim 14, wherein the tool attachment device is pivotally coupled to the receiver and rotates relative to the receiver about an axis that is perpendicular to a front face of the channel of the receiver.

17. The tool attachment system of claim 14, wherein the tool attachment device further comprises a pin spring and a button spring; wherein the pin spring is oriented between the tool attachment device and the locking pin to bias the locking pin into the locked position; and wherein the button spring is oriented between the tool attachment device and the post of the actuator to bias the actuator into the locked position.

18. The tool attachment system of claim 17, further comprising a shroud that partially surrounds the button to limit inadvertent disengagement of the tool attachment device from the receiver.

19. The tool attachment system of claim 14, wherein the receiver further comprises a belt slot and a plurality of fastener holes, the belt slot configured to receive a belt, and the fastener holes configured to receive a screw to fasten the receiver to the belt.

* * * * *